US010682667B2

(12) United States Patent
Page

(10) Patent No.: US 10,682,667 B2
(45) Date of Patent: Jun. 16, 2020

(54) DECORATING ROLLERS

(71) Applicant: Coral Tools Limited, Essex (GB)

(72) Inventor: Matthew Page, Essex (GB)

(73) Assignee: Coral Tools Limited, Essex (GB)

( * ) Notice: Subject to any disclaimer, the term of this patent is extended or adjusted under 35 U.S.C. 154(b) by 29 days.

(21) Appl. No.: 15/524,983

(22) PCT Filed: Sep. 24, 2015

(86) PCT No.: PCT/GB2015/052775
§ 371 (c)(1),
(2) Date: May 5, 2017

(87) PCT Pub. No.: WO2016/113522
PCT Pub. Date: Jul. 21, 2016

(65) Prior Publication Data

US 2017/0326582 A1 Nov. 16, 2017

(30) Foreign Application Priority Data

Jan. 13, 2015 (GB) ..... 1500502.8

(51) Int. Cl.
*B05C 17/02* (2006.01)

(52) U.S. Cl.
CPC ..... *B05C 17/02* (2013.01); *B05C 17/0205* (2013.01); *B05C 17/0217* (2013.01); *B05C 17/0242* (2013.01)

(58) Field of Classification Search
CPC . B05C 17/02; B05C 17/0205; B05C 17/0242; B05C 17/0217

(Continued)

(56) References Cited

U.S. PATENT DOCUMENTS 2,743,469 A 5/1956 Ditch
3,711,887 A * 1/1973 Chapman ..... B05C 17/02 15/230.11

(Continued)

FOREIGN PATENT DOCUMENTS

EP 389357 * 9/1990
FR 2593725 * 8/1987

(Continued)

OTHER PUBLICATIONS

GB Search Report for corresponding GB Application No. 1500502.8 dated Jan. 29, 2015, 1 page.

(Continued)

*Primary Examiner* — Mark Spisich
(74) *Attorney, Agent, or Firm* — Lee & Hayes, P.C.

(57) ABSTRACT

A retention assembly (10) for a hollow tubular decorating roller (202) comprising a fixed mount member (12) that is securable in use to a roller frame (26). The fixed mount member (12) includes a first primary support formation (16) and a first retention formation (18) that extends radially beyond the first primary support formation (16). The retention assembly (10) also includes a separable mount member (14) that is selectively couplable with the fixed mount member (12). The separable mount member (14) includes a second primary support formation (20) and a second retention formation (22) that extends radially beyond the second primary support formation (20). The first and second primary support formations (16, 20) are received, in use, by a respective end (204*a*, 204*b*) of a hollow tubular decorating roller (202). The first and second retention formations (18, 22) cooperate with one another while the separable mount member (14) is coupled with the fixed mount member (12) to in use retain a hollow tubular decorating roller (202) therebetween.

9 Claims, 4 Drawing Sheets

(58) Field of Classification Search
USPC ..... 15/230.11; 492/13, 19
See application file for complete search history.

(56) References Cited

U.S. PATENT DOCUMENTS

| | | | | |
|---|---|---|---|---|
| 3,877,123 | A * | 4/1975 | Pharris | B05C 17/02 15/230.11 |
| 4,692,048 | A | 9/1987 | Krohn et al. | |
| 5,924,157 | A * | 7/1999 | Barela | A47L 13/00 15/104.002 |
| 6,438,788 | B1 | 8/2002 | Gartner | |
| 2001/0001778 | A1* | 5/2001 | Babkowski | B05C 17/02 492/17 |
| 2003/0188395 | A1 | 10/2003 | Dove | |
| 2014/0026343 | A1 | 1/2014 | Perreault | |

FOREIGN PATENT DOCUMENTS

| | | | |
|---|---|---|---|
| FR | 2780904 | * | 1/2000 |
| GB | 768575 | * | 2/1957 |
| JP | S57152971 | | 9/1982 |
| JP | 2002-301421 | * | 10/2002 |
| WO | WO200037184 | | 6/2000 |
| WO | WO200214082 | | 2/2002 |
| WO | WO2009073871 | | 6/2009 |
| WO | WO2014135227 | | 9/2014 |

OTHER PUBLICATIONS

PCT Search Report for corresponding PCT International Application No. PCT/GB2015/052775 dated Jan. 4, 2016, 4 pages.

* cited by examiner

DECORATING ROLLERS

This Application is a US National Stage application of PCT/GB2015/052775 filed Sep. 24, 2015, which claims priority to Application GB 1500502.8, filed Jan. 13, 2015 in the United Kingdom, which is incorporated herein by reference.

This invention relates to a retention assembly for a hollow tubular decorating roller and to a decorating roller assembly.

It is known to use a hollow tubular decorating roller to apply paint to a surface, for example a wall. Typically, the hollow tubular decorating roller is rotatably secured to a roller frame to permit use of the hollow tubular decorating roller to apply paint.

According to a first aspect of the invention there is provided a retention assembly for a hollow tubular decorating roller comprising:

a fixed mount member securable in use to a roller frame and including a first primary support formation and a first retention formation extending radially beyond the first primary support formation; and a separable mount member selectively couplable with the fixed mount member, the separable mount member including a second primary support formation and a second retention formation extending radially beyond the second primary support formation, the first and second primary support formations being received, in use, by a respective end of a hollow tubular decorating roller, and the first and second retention formations cooperating with one another while the separable mount member is coupled with the fixed mount member to in use retain a hollow tubular decorating roller therebetween.

Having each of the first and second retention formations extend radially beyond a respective first or second primary support formation provides a means of retaining a hollow tubular decorating roller between the separable and fixed mount members. As such, the risk of the hollow tubular decorating roller working its way off of the fixed and separable mount members during painting is much reduced.

Meanwhile, selectively coupling the separable mount member with the fixed mount member permits ready replacement of a hollow tubular decorating roller, for example, for maintenance or cleaning purposes.

The retention assembly is therefore capable of holding a hollow tubular decorating roller in a desired position during painting, while permitting ready removal of the hollow tubular decorating roller from the retention assembly as required.

At least one of the first and second retention formations may include a plurality of discrete projection portions.

A plurality of discrete projection portions provides a means for retaining a hollow tubular decorating roller between the separable and fixed mount members while reducing the weight and material cost of the retention assembly.

Preferably at least one of the first and second retention formations includes a single projection portion extending fully around the corresponding primary support formation.

Such an arrangement provides the retention functionality of the first and/or second retention formation while also simplifying fabrication of the retention assembly.

Optionally the fixed mount member includes a roller frame fixedly secured thereto.

The fixed mount member may be rotatably secured to the roller frame. Moreover, the separable mount member may rotatably receive the roller frame such that, when the separable mount member is coupled to the fixed mount member, the separable mount member is also rotatably secured to the roller frame.

Such an arrangement allows rotational movement of a hollow tubular decorating roller relative to the roller frame in use.

The separable mount member may include a guide portion to guide the position of the roller frame relative to the separable mount member.

The inclusion of such a guide portion aids in the positioning of the separable mount member relative to the roller frame. For example, the guide portion may help to centralise a portion of the roller frame within the separable mount member. This is particularly useful when the separable mount member has been received by a hollow tubular decorating roller such that the second primary support formation is at least partially obscured from view.

In a preferred embodiment of the invention each of the first and second primary support formations includes a respective mutually engageable attachment formation, the mutually engageable attachment formations being selectively couplable with one another.

Having respective mutually engageable attachment formations provides for ready coupling of the fixed mount member with the separable mount member.

Optionally one of the mutually engageable attachment formations receives the other one of the mutually engageable attachment formations.

Such an arrangement helps to protect the received mutually engageable attachment formation from damage.

In another preferred embodiment of the invention the one of the mutually engageable attachment formations being received by the other one of the mutually engageable attachment formations lies wholly within the corresponding first or second primary support formation when the fixed and separable mount members are coupled with one another.

It will be understood that "lying wholly within" means that the mutually engageable attachment formation is either flush with the corresponding first or second primary support formation or it lies inboard of an extent of the corresponding first or second primary support formation.

Having the mutually engageable attachment formation lie wholly within the corresponding first or second primary support formation in the manner set out above reduces the risk of the mutually engageable attachment formation inadvertently becoming detached.

In addition to the foregoing, the mutually engageable attachment formation is further protected from damage since it is not protruding from the corresponding first or second primary support formation.

At least one of the mutually engageable attachment formations may include a resiliently deformable attachment formation.

Providing a resiliently deformable attachment formation allows ready attachment and detachment of the mutually engageable attachment formation while maintaining secure and robust attachment functionality.

Optionally one of the mutually engageable attachment formations includes a barb portion, the barb portion being received by the other one of the mutually engageable attachment formations.

Such an arrangement reliably prevents separation of the mutually engageable attachment formations. The barb portion is also not susceptible to becoming dislodged by relative rotational movement of the separable and fixed mount members, e.g. as may occur when painting, and so the mutually engageable attachment formations are less likely to become unintentionally detached from one another.

Preferably one of the mutually engageable attachment formations is elongate so as to extend, in use, along the length of a hollow tubular decorating roller.

One of the mutually engageable attachment formations being elongate aids in the attachment of the mutually engageable attachment formations to one another since the mutually engageable attachment formation being received by a hollow tubular decorating roller is visible at one end of the roller.

At least one of the fixed and separable mount members may include a secondary support formation to in use support an interior of a hollow tubular decorating roller.

Such a secondary support formation abuts in use an interior surface of a hollow tubular decorating roller so as to help prevent the hollow tubular decorating roller deforming during use, thereby providing better painting performance.

The secondary support formation may extend along a length of the hollow tubular decorating roller so as to prevent deformation along the whole length thereof.

According to a second aspect of the invention there is provided a decorating roller assembly comprising:

a retention assembly as described hereinabove; and a hollow tubular decorating roller within respective ends of which is received a corresponding first or second primary support formation of the retention assembly.

The decorating roller assembly shares the advantages set out above in relation to the retention assembly of the first aspect of the invention.

Optionally each of the first and second retention formations extends radially beyond an internal cavity of the hollow tubular decorating roller.

Such an arrangement holds the hollow tubular decorating roller in position relative to the retention assembly, and so the risk of the hollow tubular decorating roller working its way off of the retention assembly during painting is reduced.

There now follows a brief description of preferred embodiments of the invention, by way of non-limiting example, with reference being made to the following drawings in which.

Figure 1:
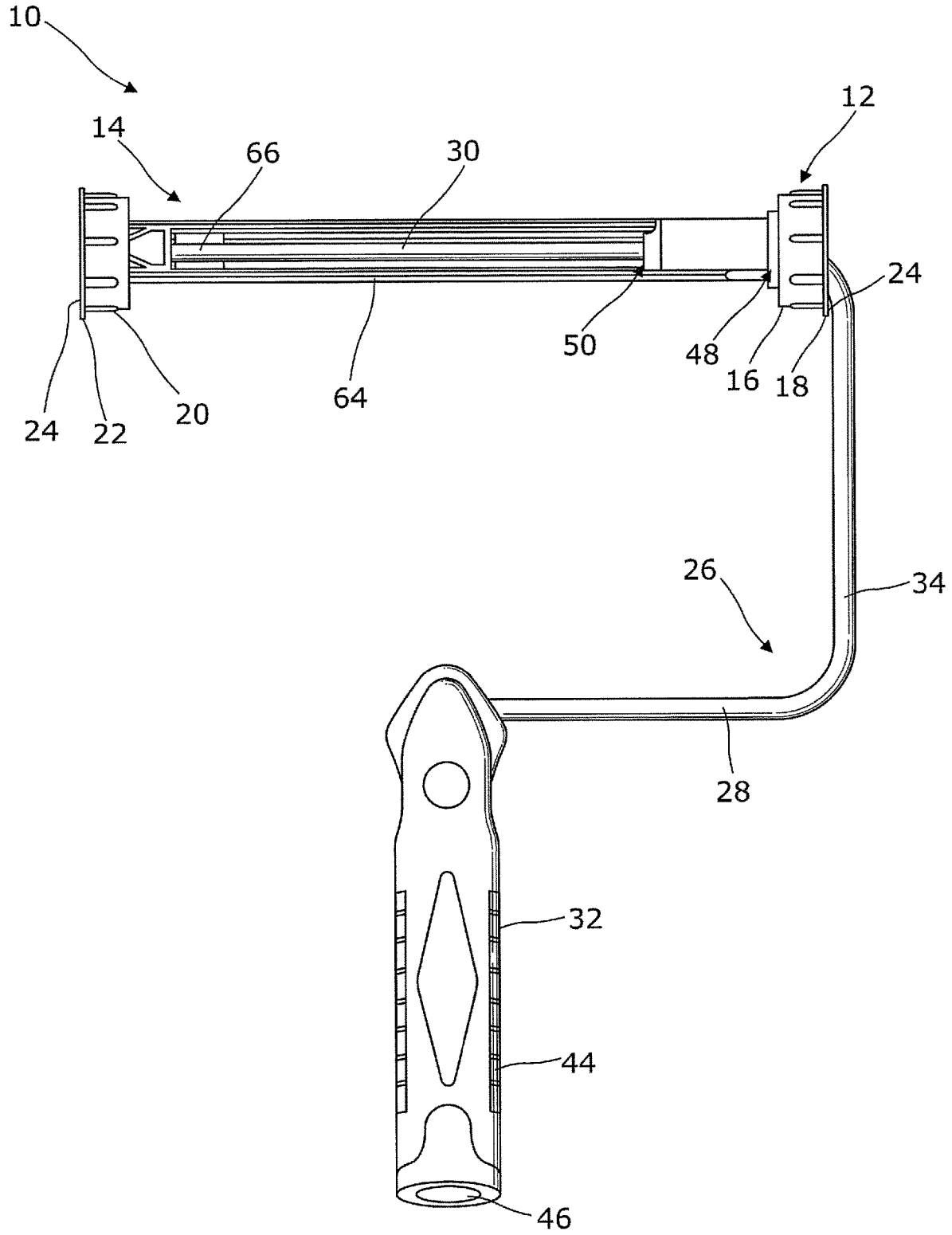
FIG. 1 shows a retention assembly according to a first embodiment of the invention.

A retention assembly according to a first embodiment of the invention is designated generally by the reference numeral 10 and is shown in FIG. 1.

The retention assembly 10 includes a fixed mount member 12 and a separable mount member 14.

The fixed mount member 12 has a first primary support formation 16 and a first retention formation 18 that extends radially beyond the first primary support formation 16.

The separable mount member 14 is selectively couplable with the fixed mount member 12, and it has a second primary support formation 20 and a second retention formation 22 that extends radially beyond the second primary support formation 20.

In the embodiment shown, each of the first and second retention formations 18, 22 is a single projection portion 24 that extends fully around its corresponding primary support formation 16, 20. Each single projection portion 24 is integrally formed with its corresponding primary support formation 16, 20. The single projection portion 24 may, in other embodiments of the invention, instead extend only part-way around its corresponding primary support formation 16, 20. The single projection 24 may also be separately formed from but secured to its corresponding primary support formation 16, 20.

In other embodiments of the invention (not shown) one or both of the first and second retention formation 18, 22 may be formed from a plurality of discrete projection portions. In further embodiments of the invention (not shown) one of the first or second retention formations 18, 22 may be formed from a plurality of discrete projection portions while the other one of the first or second retention formations 18, 22 may be formed from a single projection portion 24.

As shown in FIG. 1, the fixed mount member 12 is fixedly secured to a roller frame 26.

In the embodiment shown, the roller frame 26 is formed from a single length of round bar 28. The roller frame 26 includes a mount portion 30, a handle portion 32 and a connection portion 34 lying between the mount portion 30 and the handle portion 32.

The mount portion 30 includes an abutment formation 36 against which the fixed mount member 12 abuts to prevent the fixed mount member 12 from moving along the mount portion 30 of the roller frame 26.

Figure 2:
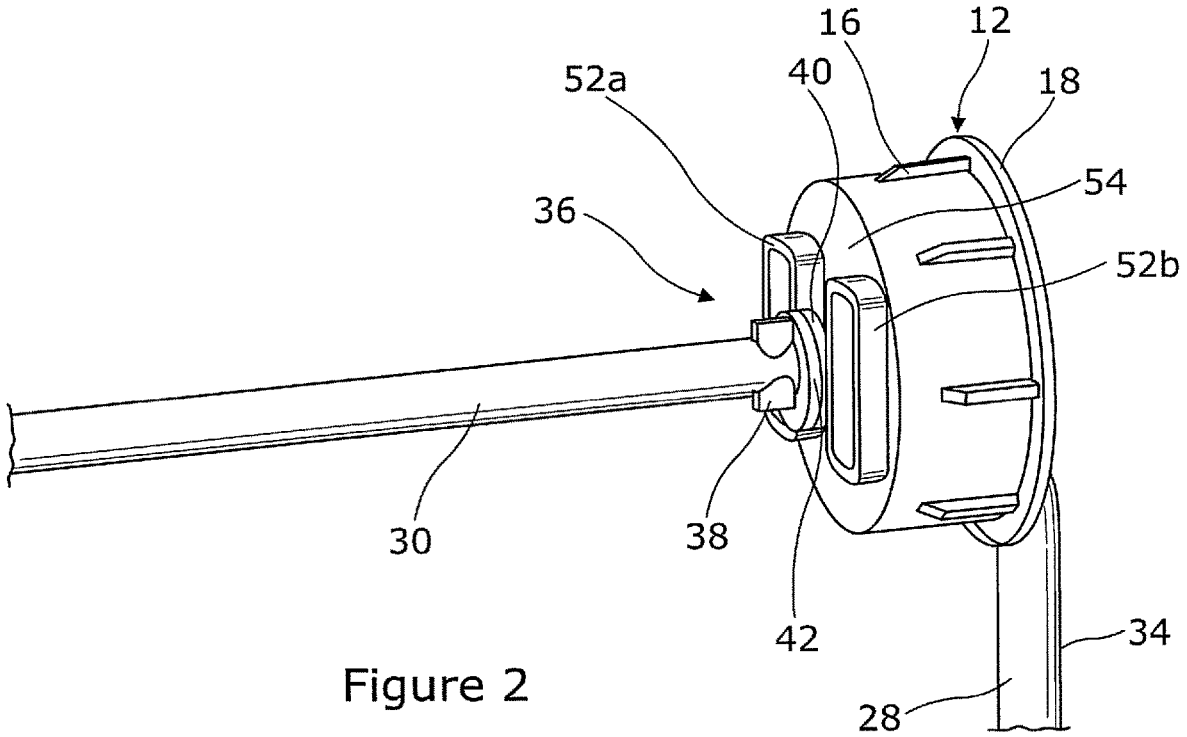
FIG. 2 shows a fixed mount member which forms a part of the retention assembly shown FIG. 1.

The abutment formation 36 is shown in more detail in FIG. 2. In this embodiment, the abutment formation 36 is a crimp 38 inserted through the wire 28 of the roller frame 26. The abutment formation 36 may take another form such as a spot of welded metal. The fixed mount member 12 abuts the crimp 38 via a washer 40 that lies between the crimp 38 and the fixed mount member 12. In other embodiments of the invention (not shown), the washer 40 may be omitted such that the fixed mount member 12 abuts the crimp 38 directly.

The fixed mount member 12 includes an aperture 42 which rotatably receives the bar 28 of the mount portion 30 of the roller frame 26 such that the fixed mount member 12 is rotatable relative to the roller frame 26. The separable mount member 14 also includes an aperture 43 to rotatably receive the bar 28 of the mount portion 30 of the roller frame 26 such that the separable mount member 14 is similarly rotatable relative to the roller frame 26. In the embodiment shown, the aperture 43 of the separable mount member 14 extends fully therethrough. The aperture 43 may instead extend part-way through the mount member 14 such that a cap (not shown) is formed at one end of the separable mount member 14. In such a further embodiment, the cap may abut an end of the bar 28 received in the aperture 43.

The fixed mount member 12 and/or the separable mount member 14 may include a bearing assembly to aid in the rotation of the fixed and/or separable mount members 12, 14 relative to the roller frame 26.

In other embodiments of the invention (not shown), the first and second retention formations 18, 22 may be fixed to the mount portion 30 of the roller frame 26, and the first and second primary support formations 16, 20 may be rotatable relative to the corresponding first or second retention formation 18, 22.

Returning to FIG. 1, the handle portion 32 of the roller frame 26 extends substantially perpendicularly to the mount portion 30 of the roller frame 26 and is spaced from the mount portion 30 by the connection portion 34.

Moreover, the handle portion 32 extends substantially perpendicularly opposite a midpoint of the mount portion 30. In other embodiments of the invention (not shown), the handle portion 32 may instead extend opposite a point offset from the midpoint of the mount portion 30.

The handle portion 32 includes a handle 44 secured thereto. The handle 44 may be secured to the handle portion 32 by, for example, a friction fit and/or by an adhesive. The handle 44, in this embodiment, includes an aperture 46 to in use receive an extension pole or other accessory.

Figure 3:
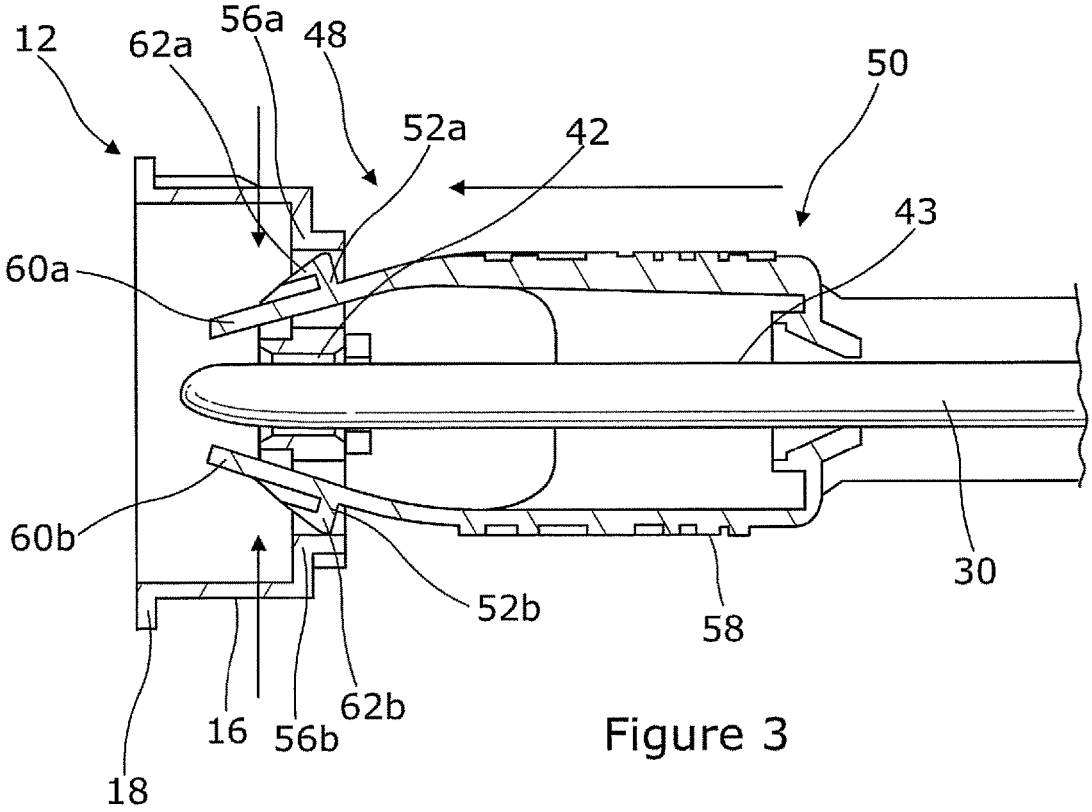
FIG. 3 shows mutually engageable attachment formations which form a part of the retention assembly shown in FIG. 1.

Each of the first and second primary support formations 16, 20 includes a respective mutually engageable attachment formation 48, 50. As shown in FIG. 3, the first primary support formation 16 includes a first mutually engageable attachment formation 48 that receives a second mutually engageable attachment 50 formation of the second primary support formation 20.

Moreover, when the first mutually engageable attachment formation 48 receives the second mutually engageable attachment formation 50, the second mutually engageable attachment formation 50 lies wholly within the first primary support formation 16. In this way, when the fixed and separable mount members 12, 14 are coupled with one another, the second mutually attachment formation 50 does not protrude beyond the extent of the first primary support formation 16.

In the embodiment of the invention shown in FIG. 3, the first mutually engageable attachment formation 48 includes first and second slots 52*a*, 52*b* formed within a face 54 of the first primary support formation 16. The slots 52*a*, 52*b* lie parallel with one another on opposite sides of the aperture 42 which receives the mount portion 30 of the roller frame 26.

The first mutually engageable attachment formation 48 further includes first and second stop portions 56*a*, 56*b*. The first and second stop portions 56*a*, 56*b* are formed from respective internal corners of each of the first and second slots 52*a*, 52*b*.

Meanwhile, the second mutually engageable attachment formation 50 includes an attachment body 58 and first and second attachment legs 60*a*, 60*b* that extend laterally from the attachment body 58.

Each of the first and second attachment legs 60*a*, 60*b* are resiliently deformable, as shown in FIG. 3, and each includes a respective barb portion 62*a*, 62*b*. The first and second barb portions 62*a*, 62*b* cooperate with a corresponding first or second stop portion 56*a*, 56*b*, when the first mutually engageable attachment formation 48 fully receives the second mutually engageable attachment formation, so as to resist separation of the second mutually engageable attachment formation 50 from the first mutually engageable attachment formation 48.

Figure 4:
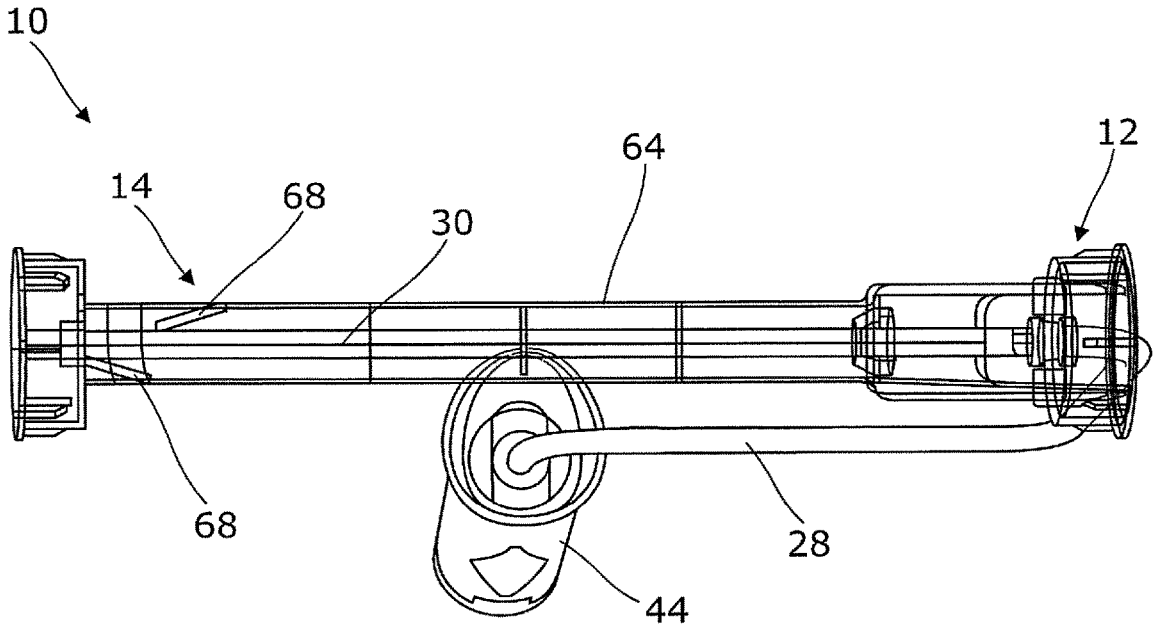
FIG. 4 shows a further view of the retention assembly shown in FIG. 1.

The second mutually engageable attachment formation 50 includes an elongate connection body 64, as shown in FIG. 4. The elongate connection body 64 connects the second primary support formation 20 to the attachment body 58 and it includes a cavity 66 to rotatably receive the mount portion 30 of the roller frame 26. The elongate connection body 64 may house, e.g. within the aforementioned cavity 66 thereof, a bearing assembly so as to aid in the rotation of the separable mount member 14 relative to the mount portion 30 of the roller frame 26.

In the embodiment shown, the second primary support formation 20, the elongate connection body 64, the attachment body 58 and the first and second attachment legs 60*a*, 60*b* are all integrally formed with one another. In other embodiments of the invention (not shown) one or more of the aforementioned features may be separately formed from the others.

In the foregoing manner, the first primary support formation 16 includes a first mutually engageable attachment formation 48 (i.e. first and second slots 52*a*, 52*b* and corresponding stop portions 56*a*, 56*b*), and the second primary support formation 20 includes a second mutually engageable attachment formation 50 (i.e. the first and second attachment legs 60*a*, 60*b* and corresponding barb portions 62*a*, 62*b*), the first mutually engageable attachment formation 48 selectively receiving the second mutually engageable attachment formation 50 to selectively secure the second mutually engageable attachment formation 50 to the first mutually engageable attachment formation 48.

In other embodiments of the invention (not shown), the first primary support formation 16 may instead include first and second attachment legs 60*a*, 60*b*, and the second primary support formation 20 may include first and second slots 52*a*, 52*b* formed on a face of the second primary support formation 20. In further still embodiments of the invention (not shown), the first primary support formation 16 may include an elongate connection body 64 with first and second attachment legs 60*a*, 60*b* extending therefrom.

As shown in FIG. 4, the elongate connection body 64 includes two guide portions 68. Each of the guide portions 68 extends from the cavity 66 at an angle less than 90° relative to the cavity 66. In this embodiment, the guide portions 68 are staggered along the length of the elongate connection body 64. In other embodiments of the invention (not shown), the elongate connection body 64 may include fewer or more guide portions 68.

Figure 5:
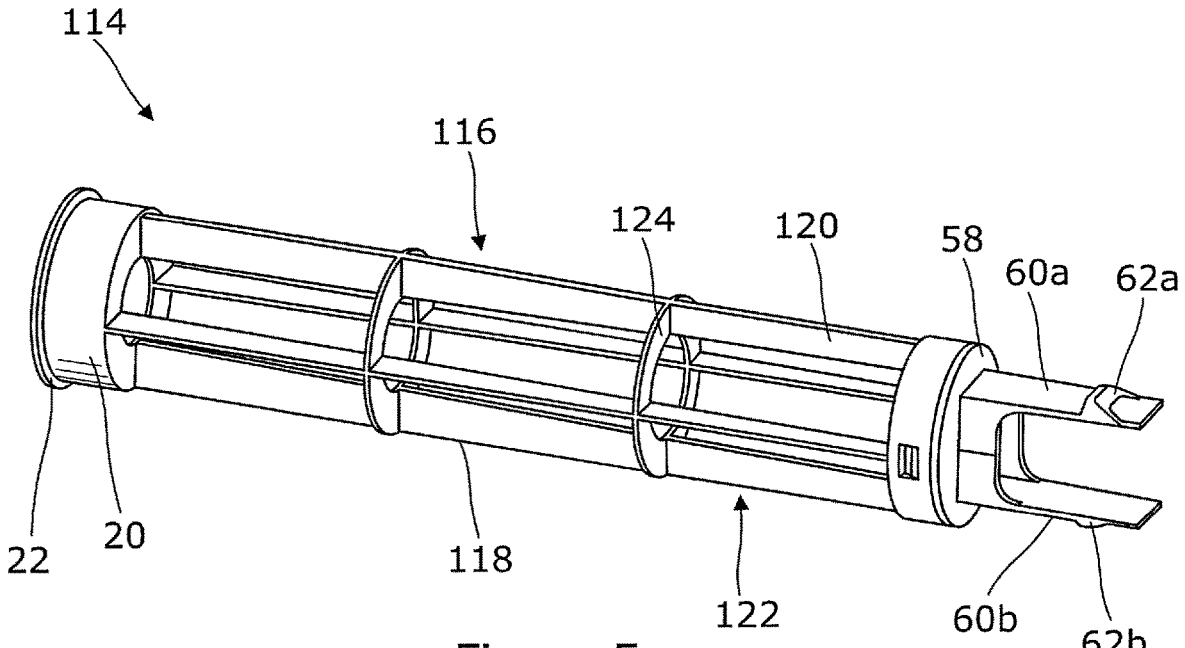
FIG. 5 shows a second separable mount member which forms a part of a retention assembly according to a second embodiment of the invention.

FIG. 5 shows a second separable mount member 114 according to another embodiment of the invention. The second separable mount member 114 includes similar features to the first separable mount member 14 shown in FIGS. 1, 3 and 4, and like features share the same reference numerals. The second separable mount member 114 differs from the first in that it additionally includes a secondary support formation 116.

The secondary support formation 116 extends laterally from the second primary support formation 20 and lies between the second primary support formation 20 and the attachment body 58 to form an elongate second mutually engageable attachment formation 118

The secondary support formation 116 includes a plurality of secondary support formation portions 120 that define a secondary support frame 122. The secondary support frame 122 includes two structural support formations 124, each of which joins the plurality of secondary support formation portions 120 to one another. The structural support formations 124 are also staggered along the length of the secondary support frame 122.

The secondary support frame 122 may include fewer than or more than two structural support formations 124.

The fixed and separable mount members 12, 14 are made from a plastic, for example polypropylene. Meanwhile the roller frame 26 is made from zinc plated steel. The roller frame 26 may instead be made from stainless steel or aluminium (e.g. grade 6061). Meanwhile the washer 40 is made from nylon. Other materials may however be used for these elements.

Figure 6:
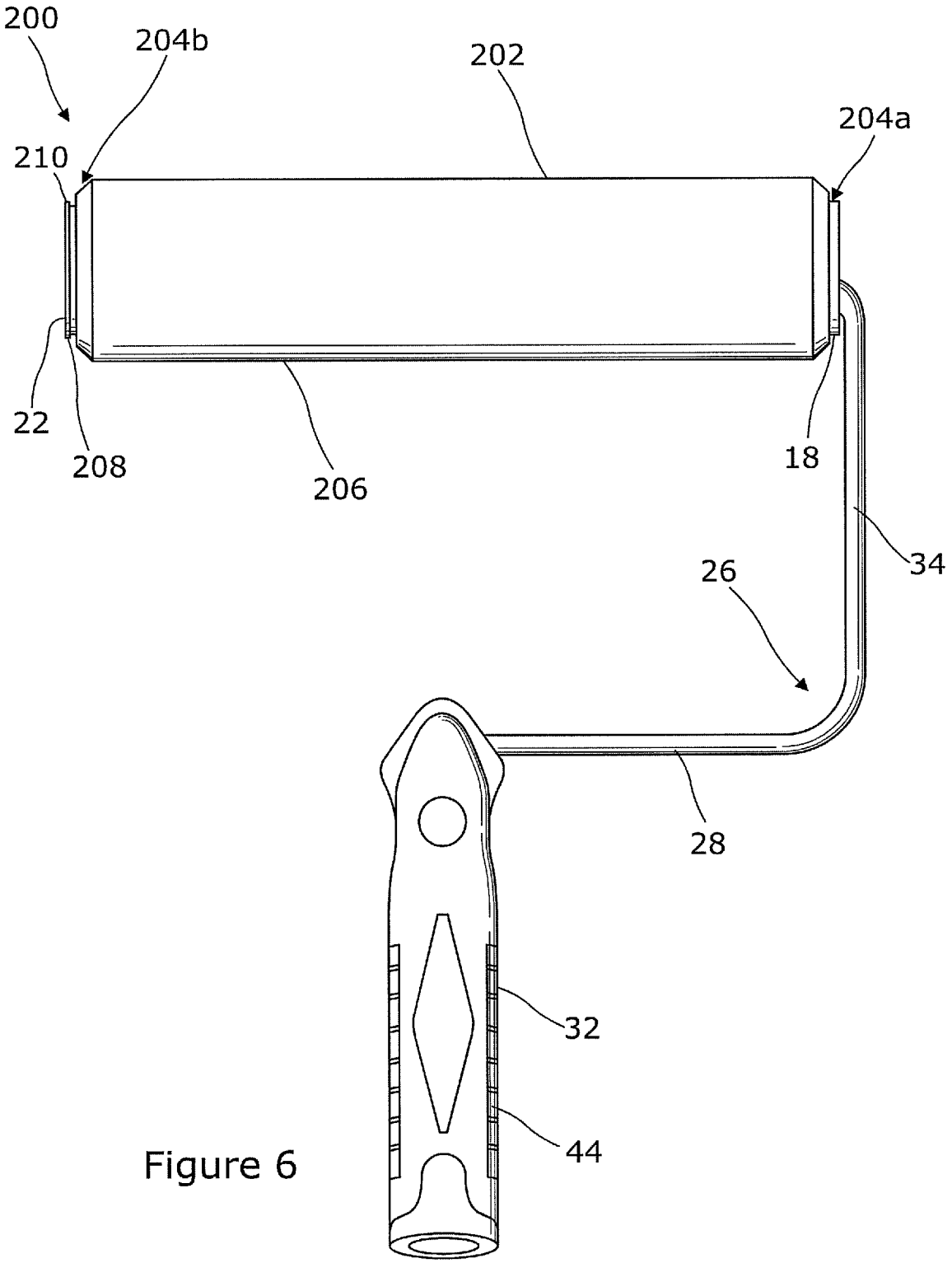
FIG. 6 shows a decorating roller assembly according to a third embodiment of the invention.

A decorating roller assembly according to a third embodiment of the invention is designated generally by the reference numeral 200 and is shown in FIG. 6.

The decorating roller assembly 200 includes a retention assembly 10 described hereinabove and as shown in FIGS. 1 to 5. The decorating roller assembly 200 further includes a hollow tubular decorating roller 202 which has first and second ends 204*a*, 204*b*. The first end 204*a* receives the first primary support formation 16 while the second end 204*b* receives the second primary support formation 20.

The hollow tubular decorating roller 202 includes a decorating sleeve 206 which extends around a roller cartridge 208. The decorating sleeve 206 is made from a knitted polyester, although other materials may also possible such as a woven acrylic material.

The roller cartridge 208 has an internal cavity 210 within which the first and second primary support formations 16, 20 are received. The first and second retention formations 18, 22 extend radially beyond the internal cavity 210.

It will be understood that the hollow tubular decorating roller 202 is a standard component. Typically, the hollow tubular decorating roller 202, and more particularly its roller cartridge 208, is made in one of three possible diameters, namely 1.5" (approximately 38 mm), 1.75" (approximately 44 mm) and 2.25" (approximately 57 mm). Other diameters are however also be possible. The hollow tubular decorating roller 202 is also typically 4" (approximately 100 mm) or 9" (approximately 220 mm) long. However, other lengths of the hollow tubular decorating roller 202 are also possible, such as 2" (approximately 50 mm), 7" (approximately 180 mm), 10" (approximately 250 mm) or 12" (approximately 305 mm).

Prior to use of the retention assembly 10 of the invention for decorating purposes, the handle portion 32 of the roller frame 26 is inserted into the washer 40 and the aperture 42 of the fixed mount member 12. The washer 40 and the fixed mount member 12 are then slid along the handle and connection portion 32, 34 of the roller frame 26 and towards the mount portion 30 of the roller frame 26.

The washer 40 abuts the crimp 38 and lies between the crimp 38 and the face 54 of the first primary support formation 16. The fixed mount member 12 is positioned between the crimp 38 and the junction at which the connection portion 34 meets the mount portion 30 of the roller frame 26.

The handle portion 32 of the roller frame 26 is then inserted into the aperture 46 of the handle 44 so as to secure the handle 44 to the roller frame 26. The additional step of applying an adhesive to the handle 44 may be taken.

The aforementioned steps are typically carried out during manufacturer of the retention assembly 10, however they may be carried out by a user of the retention assembly 10.

In readiness for using the retention assembly 10 for decorating purposes, the separable mount member 14 is separated from the fixed mount member 12 and inserted into the roller cartridge 208 of a hollow tubular decorating roller 202 such that the second primary support formation 20 is received by the second end 204*b* of the hollow tubular decorating roller 202. Meanwhile, the first and second attachment legs 60*a*, 60*b* of the second mutually engageable attachment formation 50 lie within the first end 204*a* of the hollow tubular decorating roller 202.

The second mutually engageable attachment formation 50 extends along the length of the hollow tubular decorating roller 202. If the second separable mount member 114 (i.e. as shown in FIG. 5) is used instead, then the secondary support formation 116 internally abuts the roller cartridge 208.

The separable mount member 14 is then secured to the fixed mount member 12 via the first and second mutually engageable attachment formations 48, 50 so as to retain the hollow tubular decorating roller 202 between the fixed and separable mount members 12, 14.

More specifically, the mount portion 30 of the roller frame 26 is inserted into the cavity 66 of the elongate connection body 64, and the separable mount member 14 is slid along the mount portion 30 of the roller frame 26 towards the fixed mount member 12.

When sliding the separable mount member 14 along the mount portion 30 of the roller frame 26, the guide portions 68 act to guide the mount portion 30 along the length of the elongate connection body 64 so as to centralise the mount portion 30 of the roller frame 26 within the elongate connection body 64.

The first and second attachment legs 60*a*, 60*b* are then deformed towards one another so that they enter into a corresponding first or second slot 52*a*, 52*b* of the first mutually engageable attachment formation 48. Once entered, the separable mount member 14 is pushed further towards the fixed mount member 12 so that the barb portions 62*a*, 62*b* push past a corresponding stop portion 56*a*, 56*b* thereby allowing the first and second attachment legs 60*a*, 60*b* to return to their undeformed, i.e. relaxed, state. In the relaxed state, the barb portions 62*a*, 62*b* abut against a respective stop portion 56*a*, 56*b* so as to secure the separable mount member 14 to the fixed mount member 12.

A user is then able to load the decorating sleeve 206 with paint and apply the paint to a surface, e.g. a wall, by rolling the hollow tubular roller 202 over the surface without the hollow tubular roller 202 coming away from the roller frame 26.

To remove the hollow tubular roller 202 from the roller frame 26, the first and second attachment legs 60*a*, 60*b* are again deformed towards one another so as to release the barb portions 62*a*, 62*b* from the respective stop portion 56*a*, 56*b*. The separable mount member 14 is then pulled away from the fixed mount member 12 along the mount portion 30 of the roller frame 26.

The hollow tubular roller 202 can then be removed from the separable mount member 14 by sliding the hollow tubular roller 202 along the elongate connection body 64 and away from the second primary support formation 20. The hollow tubular roller 202 can then be replaced or cleaned as desired.

The invention claimed is:

1. A retention assembly for a hollow tubular decorating roller comprising:

a fixed mount member securable in use to a roller frame and including a first primary support formation and a first retention formation extending radially beyond the first primary support formation; and a separable mount member selectively couplable with the fixed mount member, the separable mount member including a second primary support formation and a second retention formation extending radially beyond the second primary support formation, the first and second primary support formations being received, in use, by a respective end of a hollow tubular decorating roller, and the first and second retention formations cooperating with one another while the separable mount member is coupled with the fixed mount member to in use retain a hollow tubular decorating roller therebetween, wherein each of the first and second primary support formations includes a respective mutually engageable attachment formation, the mutually engageable attachment formations being selectively couplable with one another, wherein one of the mutually engageable attachment formations receives the other one of the mutually engageable attachment formations, the one of the mutually engageable attachment formations including first and second slots formed on an outer face of the one of the mutually engageable attachment formations, and further including first and second stop portions formed within the one of the mutually engageable attachment formations, the other one of the mutually engageable attachment formations including first and second resiliently deformable attachment legs, wherein the first and second attachment legs are configured to deform, in use, towards one another to selectively permit entry and exit of the legs into and out of a respective slot, and wherein a barb portion of each first and second attachment leg is configured to locate past and abut against a corresponding stop portion of the one of the mutually engageable attachment formations to resist separation of the mutually engageable attachment formations.

2. A retention assembly according to claim 1 wherein at least one of the first and second retention formations includes a single projection portion extending fully around the corresponding primary support formation.

3. A retention assembly according to claim 1 wherein the fixed mount member includes a roller frame fixedly secured thereto.

4. A retention assembly according to claim 3 wherein the separable mount member includes a guide portion to guide the position of the roller frame relative to the separable mount member.

5. A retention assembly according to claim 1, wherein the other one of the mutually engageable attachment formations being received by the one of the mutually engageable attachment formations lies wholly within the corresponding first or second primary support formation when the fixed and separable mount members are coupled with one another.

6. A retention assembly according to claim 1, wherein the other one of the mutually engageable attachment formations is elongate so as to extend, in use, along the length of a hollow tubular decorating roller.

7. A retention assembly according to claim 1 wherein at least one of the fixed and separable mount members includes a secondary support formation to in use support an interior of a hollow tubular decorating roller.

8. A decorating roller assembly comprising:

a retention assembly according to claim 1; and a hollow tubular decorating roller within respective ends of which is received a corresponding first or second primary support formation of the retention assembly.

9. A decorating roller assembly according to claim 8 wherein each of the first and second retention formations extends radially beyond an internal cavity of the hollow tubular decorating roller.

* * * * *